US007479026B2

(12) United States Patent
Furusawa et al.

(10) Patent No.: US 7,479,026 B2
(45) Date of Patent: Jan. 20, 2009

(54) CABLE-EQUIPPED CONNECTOR

(75) Inventors: Sadatoshi Furusawa, Tokyo (JP); Taku Kawano, Tokyo (JP)

(73) Assignee: Honda Tsushin Kogyo Co., Ltd., Tokyo (JP)

( * ) Notice: Subject to any disclaimer, the term of this patent is extended or adjusted under 35 U.S.C. 154(b) by 0 days.

(21) Appl. No.: 11/905,059

(22) Filed: Sep. 27, 2007

(65) Prior Publication Data

US 2008/0093105 A1 Apr. 24, 2008

(30) Foreign Application Priority Data

Oct. 23, 2006 (JP) ..... 2006-287325

(51) Int. Cl.
*H01R 13/627* (2006.01)

(52) U.S. Cl. ..... 439/362; 439/372

(58) Field of Classification Search ..... 439/362, 439/372

See application file for complete search history.

(56) References Cited

U.S. PATENT DOCUMENTS 5,098,312 A * 3/1992 Raczynski ..... 439/362
5,800,197 A * 9/1998 Hyzin ..... 439/372
6,406,315 B1 * 6/2002 Bates et al. ..... 439/310

FOREIGN PATENT DOCUMENTS

JP 9-190861 7/1997

* cited by examiner

*Primary Examiner*—Tho D Ta
*Assistant Examiner*—Travis Chambers
(74) *Attorney, Agent, or Firm*—Wenderoth, Lind & Ponack, L.L.P.

(57) ABSTRACT

To improve connector installation density and utilize space effectively, a cable-equipped connector is capable of coupling separation-prevention lock screws at any position around the other connector. The cable-equipped connector includes a connector body, a cable connected to a rear of the connector body, an insulating synthetic resin housing that covers a connecting portion, a mounting block disposed so as to be rotatable with respect to the housing, and lock screws that rotatably engage through-holes formed in both ends of the mounting block.

2 Claims, 6 Drawing Sheets

CABLE-EQUIPPED CONNECTOR

BACKGROUND OF THE INVENTION

1. Field of the Invention

The present invention relates to a cable-equipped connector having lock screws that prevent connectors from separating when connected to each other.

2. Related Art

Conventionally, a cable-equipped connector 23 having lock screws like that shown in FIGS. 7A-7C is known. The cable-equipped connector 23 is such that a cable 24 for electrical signals is connected to a rear of the connector body 23*c* and a connecting portion of the cable 24 is covered by a synthetic resin housing 23*a*, on which a mounting block 25 that projects laterally is integrally formed with the housing 23*a*. Through-holes 25*a* are provided in both lateral ends of the mounting block 25, and lock screws 26 engage the through-holes 25*a* so as to be rotatable therewithin.

As shown in FIGS. 8A-8C, another connector 20 to which the above cable-equipped connector 23 is connected has screw nuts 21 provided on lateral side portions 20*a*, 20*b*. The screw nuts 21, as shown in FIGS. 9A and 9B, are inserted into through-holes 22*a* provided on a panel 22 or a side of a device housing and fixedly mounted thereat. In other words, the connector 20 is fixedly attached to the panel 22, which is a portion of the housing of an electronic device, and further, is soldered to and mounted on a printed circuit board, with the screw nuts 21 passed through the through-holes 22*a* in the panel 22 and fixedly mounted, female screw parts thereof being provided on the outside of the device panel.

The cable-equipped connector 23, as shown in FIGS. 9A and 9B, has male connector portions 23*b* inserted into and engaging female connector portions 20*c* of the connector 20, and has male portions of the lock screws 26 screwed into female screw portions of the screw nuts 21. Thus, both connectors 20 and 23 are mated and electrically connected, and at the same time the lock screws 26 ensure that the connectors do not separate easily even when a tensile force is exerted on the cable 24 (see, for example, JP-A-09-190861).

However, because the lock screws 26 of such conventional cable-equipped connector 23 are provided on the mounting block 25 formed as a single integrated unit with the synthetic resin housing 23*a* that covers the connecting portion, once the direction of engagement of the connector 20 and the cable-equipped connector 23 is decided, the positions and orientations of the lock screws 26 and the screw nuts 21 as well as the through-holes 22*a* are automatically decided as well.

Therefore, ordinarily, the connector 20 is provided so as to be mounted horizontally on the panel or the like of the device, and thus the direction in which the screw nuts 21 and the lock screws 36 are mounted is fixed horizontally, such that other connectors or the like cannot be installed in dense formation on either side of the connector 20. In such a case, for example, even if space above and below the connector 20 is open, ordinarily a plurality of connectors or the like are arrayed horizontally, and such space cannot be utilized effectively.

SUMMARY OF THE INVENTION

The present invention is conceived in light of the problem of the background art described above, and has as its object to provide a cable-equipped connector that can be arranged in dense formation so as to make effective use of space on a panel side of a device.

Accordingly, the cable-equipped connector according to the present invention includes a connector body, a cable connected to a rear of the connector body, an insulating synthetic resin housing that covers a connecting portion of the cable, a mounting block disposed so as to be rotatable with respect to the housing, and lock screws that rotatably engage through-holes formed in both ends of the mounting block.

Preferably, the housing includes a cylindrical shaft formed in a center in a long direction of the housing, a flange formed forward of the shaft and having a diameter larger than a diameter of the shaft, and a cap formed rearward of the shaft and having a diameter larger than the diameter of the shaft, and the mounting block rotatably engages the shaft.

In addition, preferably, outer peripheral side surfaces of a center portion intermediate between the through-holes formed in both ends of the mounting block are flat surfaces cut off in parallel. Further, preferably, both side surfaces of the flange of the housing are flat surfaces cut off perpendicularly to prevent the flange from protruding beyond an outer periphery of the mounting block.

The cable-equipped connector of the present invention has the mounting block rotatably mounted on the housing so that the mounting block can rotate with respect to the housing, thus enabling the mounting block of the cable-equipped connector side to be aligned with the positions of the nut portions and rotated, and the lock screws to be engaged with the screw nuts or the nut portions of the panel, even when the connector is mounted on the panel side of the device with a latitudinal direction of the connector body disposed horizontally as is conventionally the case and the screw nuts or the nut portions provided on the panel are positioned freely and mounted at positions such as diagonally to the connector body or rotated so as to be perpendicular to the connector body.

Therefore, even when the connector fixedly mounted on the panel side of the device is mounted on the panel in such a way that the latitudinal direction of the connector is horizontal, provided that the mounting positions of the screw nuts with respect to the panel are such as to leave empty space diagonal to the connector or above and below the connector, the cable-equipped connector can be freely disposed in that empty space. As a result, design freedom with respect to the disposition of components increases and other signal connectors can be placed alongside the connector of the panel side of the device and densely disposed thereat, enabling the space on the device panel side to be utilized effectively.

In addition, because no screw nuts are provided on the device panel side connector and female screws for the lock screws can be provided on the panel and used as nuts instead, the number of components of such panel side connector can be decreased, thus reducing costs.

Further, when the outer peripheral side surfaces of a center portion intermediate between the through-holes formed in both ends of the mounting block are flat surfaces cut off in parallel, a larger space can be formed between adjacent connectors, thus reducing interference for connectors connected to other connectors on the panel side and facilitates the work of connecting the connectors.

Other objects, features and advantages of the present invention will be apparent from the following description when taken in conjunction with the accompanying drawings, in which like reference characters designate the same or similar parts throughout the figures thereof.

DETAILED DESCRIPTION OF THE PREFERRED EMBODIMENTS

Figure 1:
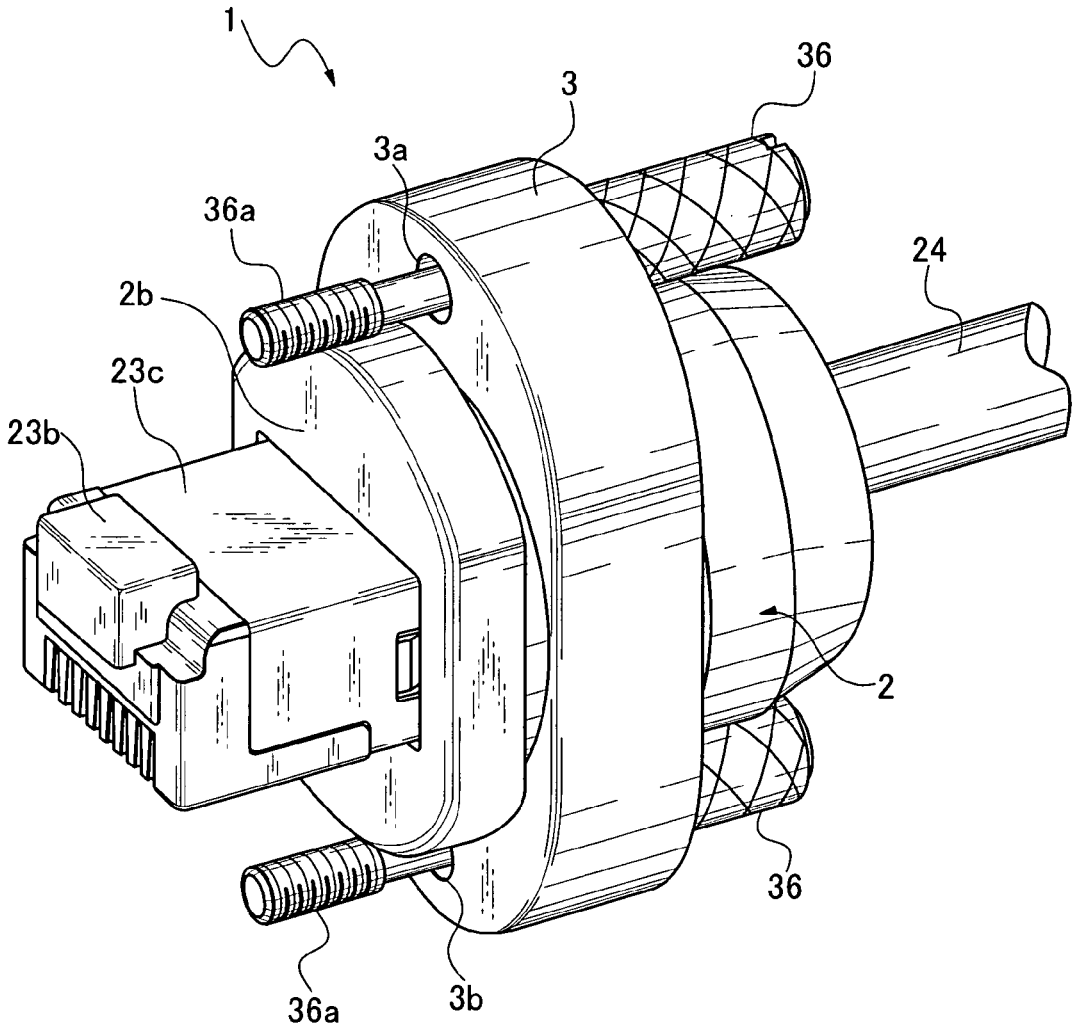
FIG. 1 is a perspective view of a cable-equipped connector according to one embodiment of the present invention.

A detailed description will now be given of a preferred embodiment of the present invention, with reference to the accompanying drawings. A cable-equipped connector 1, as shown in FIG. 1, comprises a connector body 23*c* having a male connector portion 23*b*, a cable 24 connected to a rear of the connector body 23*c*, an insulating synthetic resin housing 2 that covers a connecting portion of the cable 24, a mounting block 3 disposed so as to be rotatable with respect to the housing 2, and lock screws 36 that rotatably engage through-holes 3*a*, 3*b* formed in both ends of the mounting block.

Figure 2A:
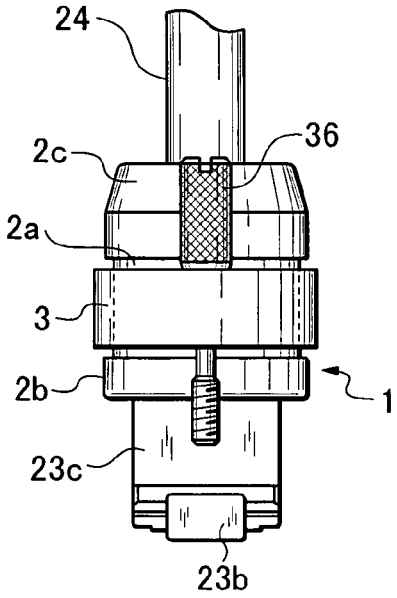
FIGS. 2A, 2B and 2C are top, front, and side views, respectively, of a mounting block of the cable-equipped connector.
Figure 2B:
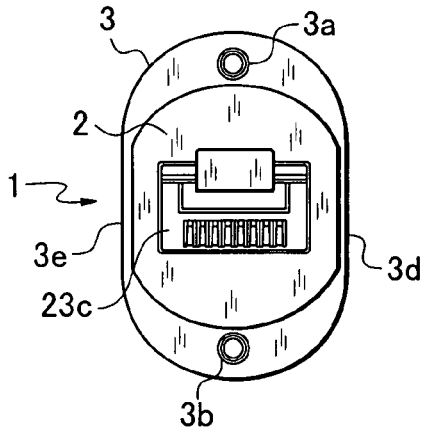
Figure 2C:
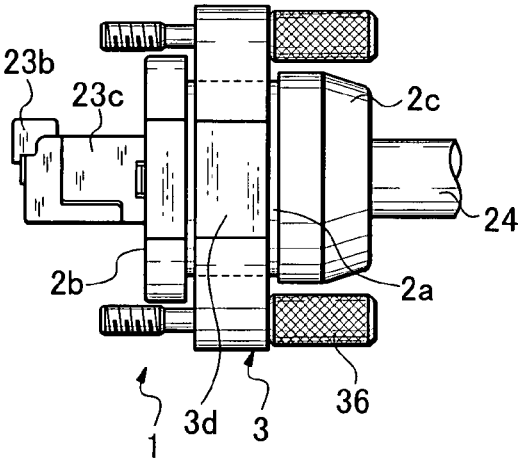

The housing 2, as shown in FIGS. 2A-2C, comprises a cylindrical shaft 2*a* formed in a center of the housing 2 in a long direction of the housing 2, a sword guard-shaped flange 2*b* formed forward of the shaft 2*a* to a diameter larger than a diameter of the shaft 2*a*, and a cap 2*c* formed rearward of the shaft 2*a* to a diameter larger than the diameter of the shaft 2*a*. The mounting block 3 is rotatably mounted on the shaft 2*a*. The cable-equipped connector 1 is assembled by rotatably mounting the mounting block 3 on the shaft 2*a* in advance and then inserting the cap 2*c*, through which the cable 24 is already passed, into a rear end of the shaft 2*a*.

It should be noted that side surfaces of the mounting block 3 in which the through-holes 3*a*, 3*b* are not formed, that is, the two side surfaces perpendicular to a hypothetical straight line between the through-holes 3*a*, 3*b*, have been cut off so that in cross-section the mounting block 3 is in the shape of a drum so as to form flat surfaces 3*d*, 3*e*, with a width between the cut-off flat surfaces 3*d*, 3*e* made as small as possible. Similarly, with respect to the flange 2*b* of the housing 2 as well, both side surfaces of the flange 2*b* in a horizontal direction side of the connector body 23*c* are cut off vertically to form flat surfaces, so as to prevent the flange 2*b* from protruding beyond the mounting block 3.

Figure 3:
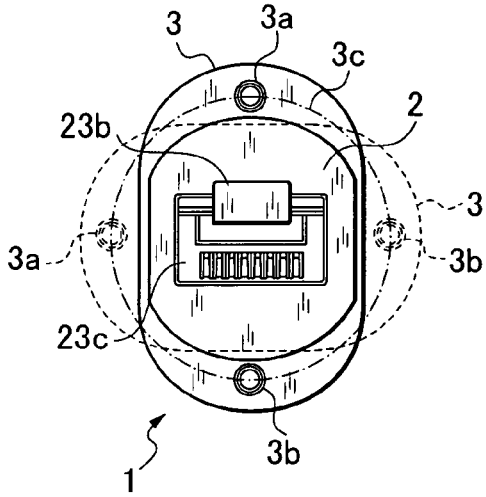
FIG. 3 illustrates rotatability of the mounting block of the cable-equipped connector.
Figure 4A:
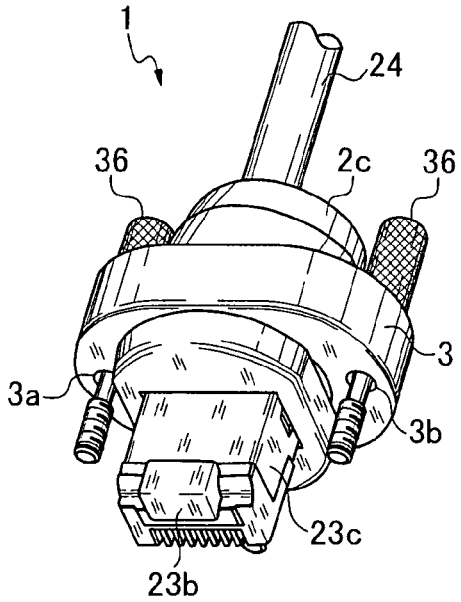
FIGS. 4A, 4B, 4C and 4D are perspective, top, front, and side views, respectively, of a state in which the mounting block of the cable-equipped connector is rotated and put in a horizontal state.
Figure 4B:
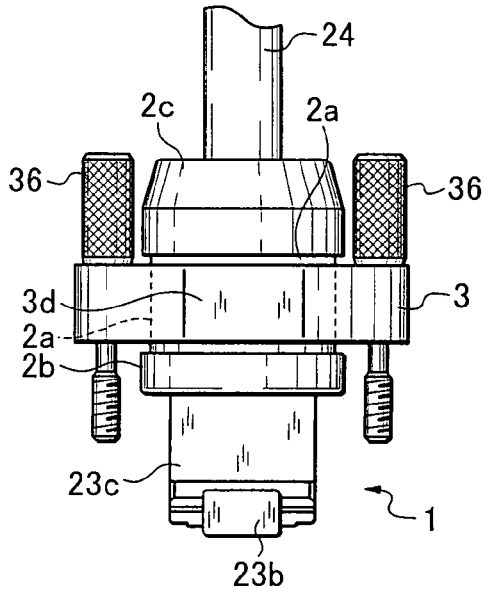
Figure 4C:
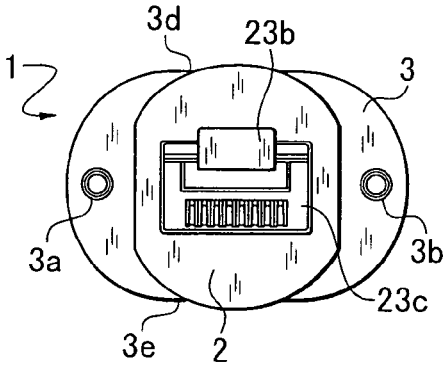
Figure 4D:
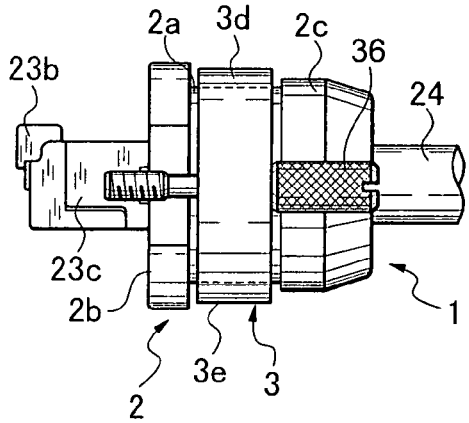

When a latitudinal direction of the connector body 23*c* of the cable-equipped connector 1 is horizontal as shown in FIG. 3, by rotating the mounting block 3 on the shaft 2*a* of the housing 2 in a circumferential direction, the through-holes 3*a*, 3*b* can be positioned longitudinally along a hypothetical orbital path 3*c* traced by centers of the through-holes 3*a*, 3*b*, and moreover, as shown by the dashed line in FIG. 3, the through-holes 3*a*, 3*b* can be positioned latitudinally as well (see FIGS. 4A-4D), and further, can be positioned diagonally at any angle.

Figure 5A:
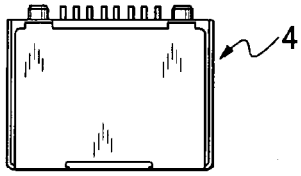
FIGS. 5A, 5B and 5C are top, front, and side views, respectively, of a connector fixedly mounted on a panel side of a device to which the cable-equipped connector is attached.
Figure 5B:
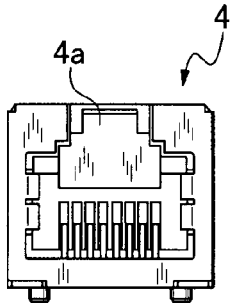
Figure 5C:
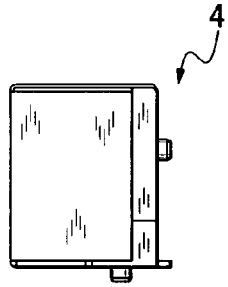

At the same time, as shown in FIGS. 5A-5C, a connector 4 fixedly mounted on the panel side of the device engaging the cable-equipped connector 1 is only the connecting portion, and as in the conventional example there is no need to install screw nuts. This is because, as shown in FIGS. 6A-6C, female screw portions 5*a*, 5*b* for the lock screws 36 can be formed on a device panel 5 around a connector 4 through-hole 5*c* at a predetermined distance from the center thereof, so as to be disposed horizontally (FIG. 6A), longitudinally (FIG. 6B), at positions rotated 60 degrees counter-clockwise from the horizontal (FIG. 6C), or at any arbitrary angle.

Figure 6A:
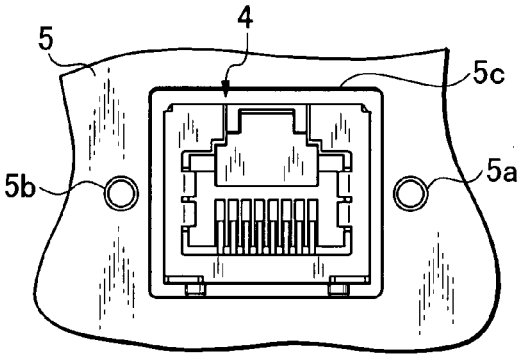
FIGS. 6A, 6B and 6C are partial front views of various dispositions of female screw portions for lock screws in a case in which the connector is fixedly mounted on the device panel.
Figure 6B:
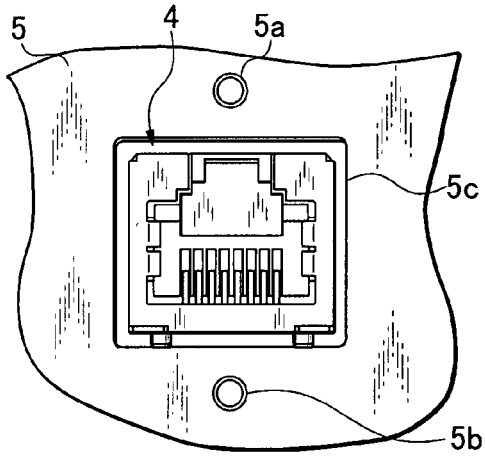
Figure 6C:
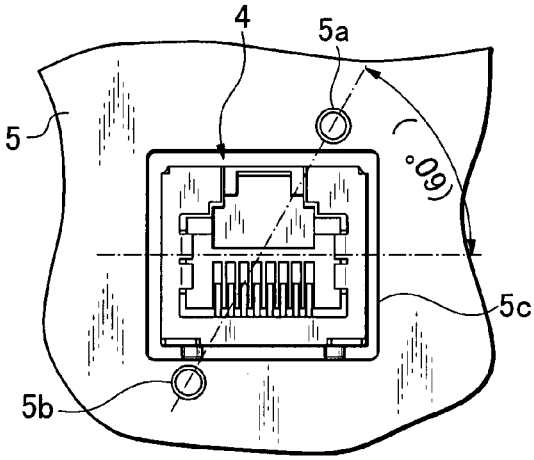
Figure 7A:
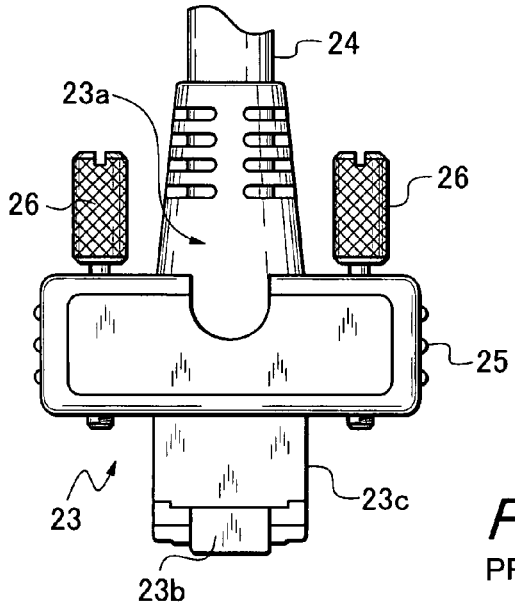
Fig. 7A PRIOR ART
FIGS. 7A, 7B and 7C are top, side, and front views, respectively, of a conventional cable-equipped connector.
Figure 7C:
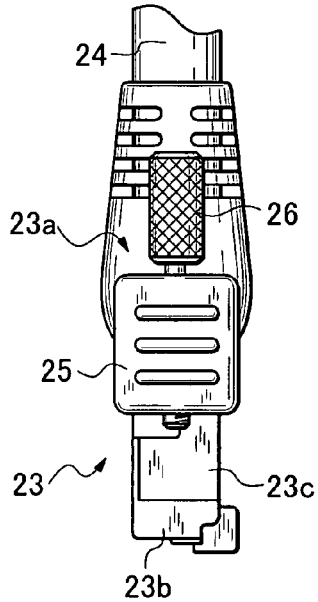
Fig. 7C PRIOR ART
Figure 7B:
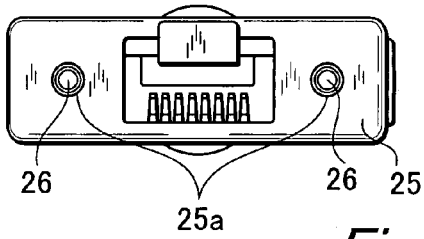
Fig. 7B PRIOR ART
Figure 8A:
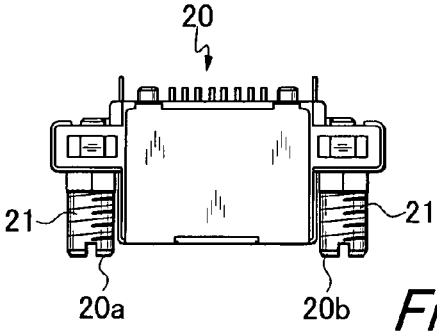
Fig. 8A PRIOR ART
FIGS. 8A, 8B and 8C are top, front and side views of a connector fixedly mounted on a panel side of a device to which the conventional cable-equipped connector shown in FIGS. 7A-7C is connected.
Figure 8B:
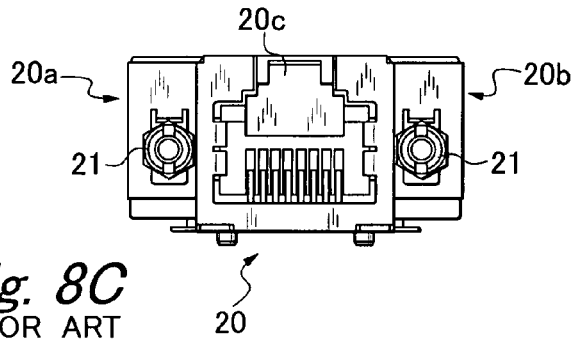
Fig. 8B PRIOR ART
Figure 8C:
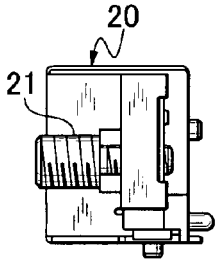
Fig. 8C PRIOR ART
Figure 9A:
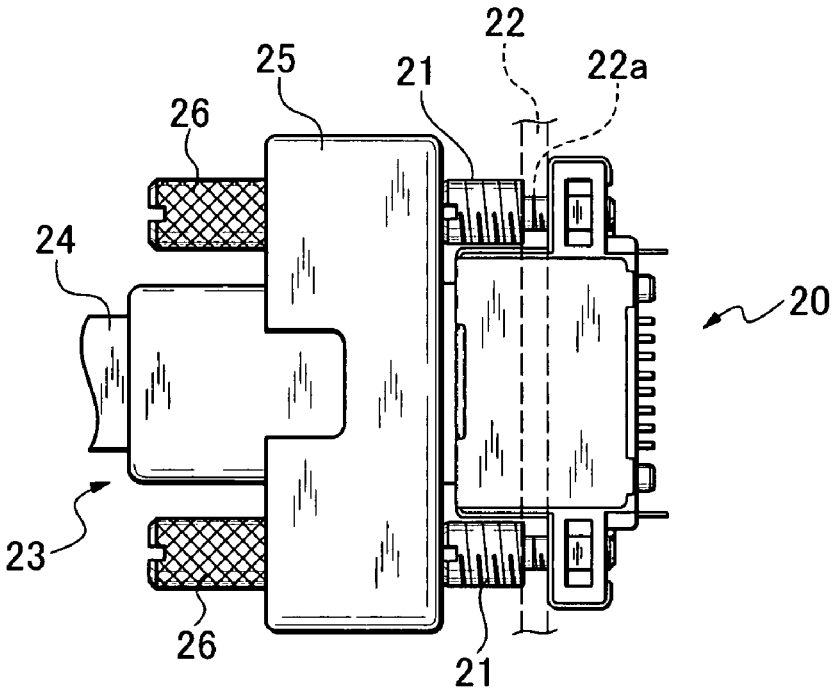
Fig. 9A PRIOR ART
FIGS. 9A and 9B are top and side views, respectively, of the conventional cable-equipped connector in use.
Figure 9B:
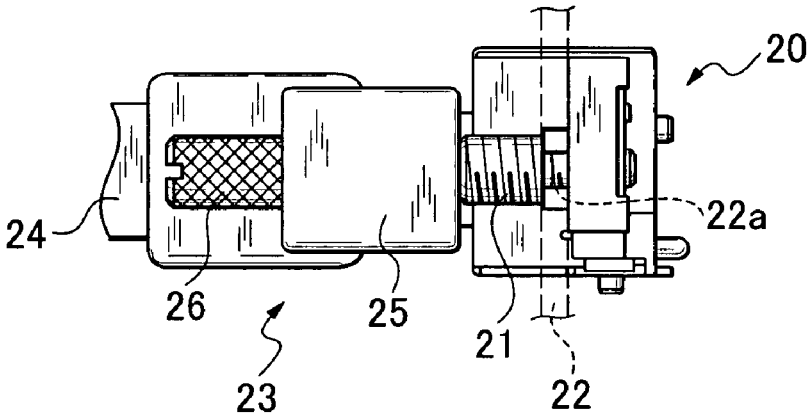
Fig. 9B PRIOR ART

Thus, as described above, the cable-equipped connector 1 having the rotatable mounting block 3 is the same as the conventional example when connected to the connector 4 shown in FIG. 6A, but when the female screw portions 5*a*, 5*b* are formed longitudinally as shown in FIG. 6B, the male connector portion 23*b* of the cable-equipped connector 1 is aligned with and engaged with the female connector 4*a* of the connector 4, and the through-holes 3*a*, 3*b* and the lock screws 36 are rotated and moved to the longitudinal direction as shown in FIGS. 2A-2C and engaged with the female screw portions and connected so as to prevent separation. At this time, on the panel 5 side there is space on either side of the connector 4, and thus other connectors or the like can be disposed in dose, dense formation.

As many seemingly widely different embodiments and variations of the present invention are possible without departing from the spirit and scope thereof, it is to be understood that the present invention is not limited to the specific embodiments thereof and described herein except as defined in the appended claims.

What is claimed is:

1. A cable-equipped connector comprising:

a connector body;

a cable connected to a rear of the connector body;

an insulating synthetic resin housing that covers a connecting portion of the cable;

a mounting block disposed so as to be rotatable with respect to the housing; and lock screws that rotatably engage through-holes formed in both ends of the mounting block;

wherein the housing includes a cylindrical shaft formed in a center in a long direction of the housing, a flange formed forward of the shaft and having a diameter larger than a diameter of the shaft, and a cap formed rearward of the shaft and having a diameter larger than the diameter of the shaft;

wherein the mounting block rotatably engages the shaft; and wherein outer peripheral side surfaces of a center portion intermediate between the through-holes formed in both ends of the mounting block are flat surfaces cut off in parallel.

2. The cable-equipped connector according to claim 1, wherein both side surfaces of the flange of the housing are flat surfaces cut off perpendicularly to prevent the flange from protruding beyond an outer periphery of the mounting block.

* * * * *